US007021928B1

(12) United States Patent
Fehsenmayr et al.

(10) Patent No.: US 7,021,928 B1
(45) Date of Patent: Apr. 4, 2006

(54) PLATE FOR A SLIDING COOLER GRATE

(75) Inventors: Theo Fehsenmayr, Aalen (DE); Reiner Fruhling, Hamburg (DE); Frank Heinrich, Harsefeld (DE); Hartmut Meyer, Thomasburg (DE)

(73) Assignee: Claudius Peters Technologies GmbH, Buxtehude (DE)

( * ) Notice: Subject to any disclaimer, the term of this patent is extended or adjusted under 35 U.S.C. 154(b) by 0 days.

(21) Appl. No.: 08/666,295

(22) PCT Filed: Nov. 6, 1995

(86) PCT No.: PCT/EP95/04370

§ 371 (c)(1),
(2), (4) Date: Jul. 10, 1996

(87) PCT Pub. No.: WO96/14549

PCT Pub. Date: May 17, 1996

(30) Foreign Application Priority Data

Nov. 7, 1994 (DE) ..... G94 17 829 U

(51) Int. Cl.
*F23K 23/08* (2006.01)

(52) U.S. Cl. ..... 432/78; 110/268; 110/281

(58) Field of Classification Search ..... 432/77, 432/78, 137; 110/268, 270, 278, 281
See application file for complete search history.

(56) References Cited

U.S. PATENT DOCUMENTS

| | | | | |
|---|---|---|---|---|
| 4,200,047 | A * | 4/1980 | Knorr | 110/281 |
| 4,870,913 | A * | 10/1989 | Schneider | 110/299 |
| 5,322,434 | A | 6/1994 | Milewski et al. | 432/78 |
| 5,549,471 | A * | 8/1996 | Tegtmeier et al. | 432/77 |
| 5,575,642 | A * | 11/1996 | Willis et al. | 432/78 |
| 5,626,089 | A * | 5/1997 | Schneider et al. | 110/281 |
| 5,882,189 | A * | 3/1999 | Fehsenmayr et al. | 432/78 |
| 5,947,719 | A * | 9/1999 | Heinemann et al. | 432/78 |

FOREIGN PATENT DOCUMENTS

| | | |
|---|---|---|
| DE | 1 134 329 | 8/1962 |
| EP | 0 337 383 A1 | 10/1989 |
| EP | 0 537 523 A1 | 4/1993 |

* cited by examiner

*Primary Examiner*—Gregory Wilson
(74) *Attorney, Agent, or Firm*—Alix, Yale & Ristas, LLP

(57) ABSTRACT

Grate plate for the push-type grate of a clinker cooler, which has a topside bearing surface exposed to the hot material to be cooled. The grate plate including a rear region having devices for connection to a grate-plate carrier, such that the grate plate front projects over an adjacent grate plate. Longitudinally extending edge strips are connected in a force-transmitting manner to the devices for connection to the grate-plate carrier to support the plate front. The topside bearing surface is formed by a cover plate which is free of the edge strips, at least in front of the grate-plate carrier, and which has freedom of expansion in the horizontal direction in relation to the support part comprising the edge strips.

13 Claims, 4 Drawing Sheets

FIG. 1
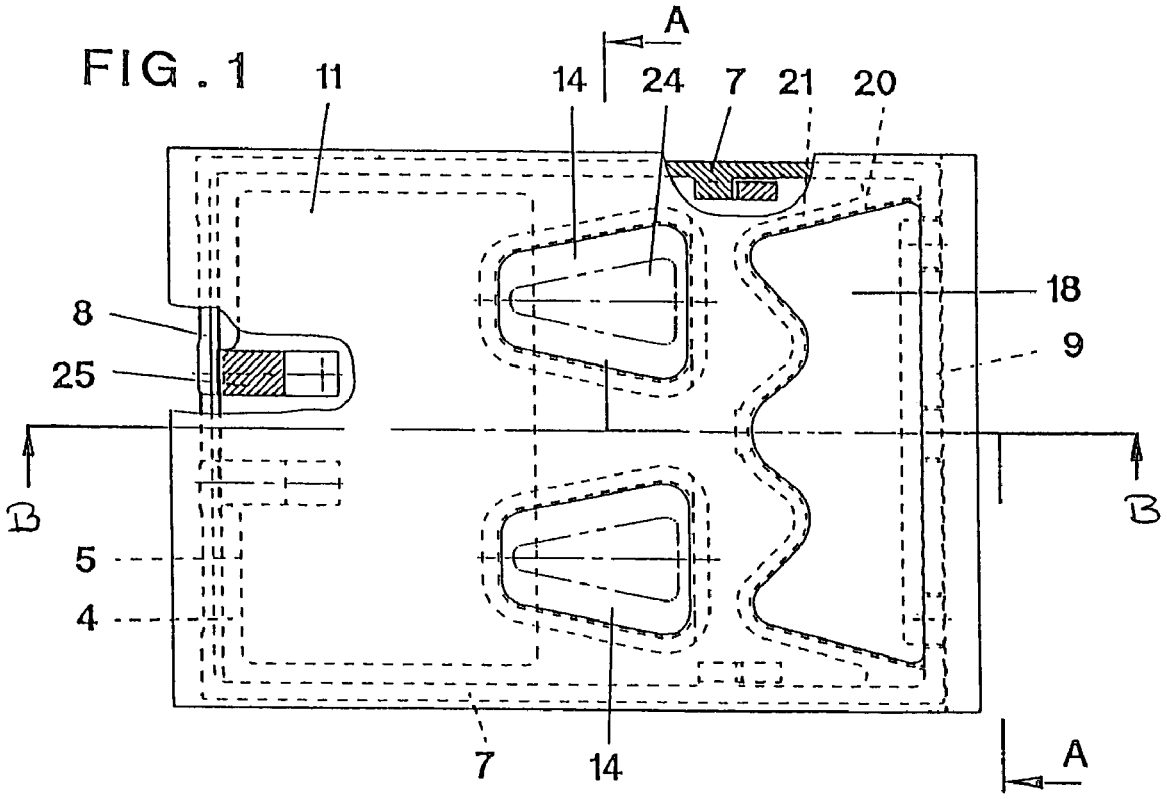
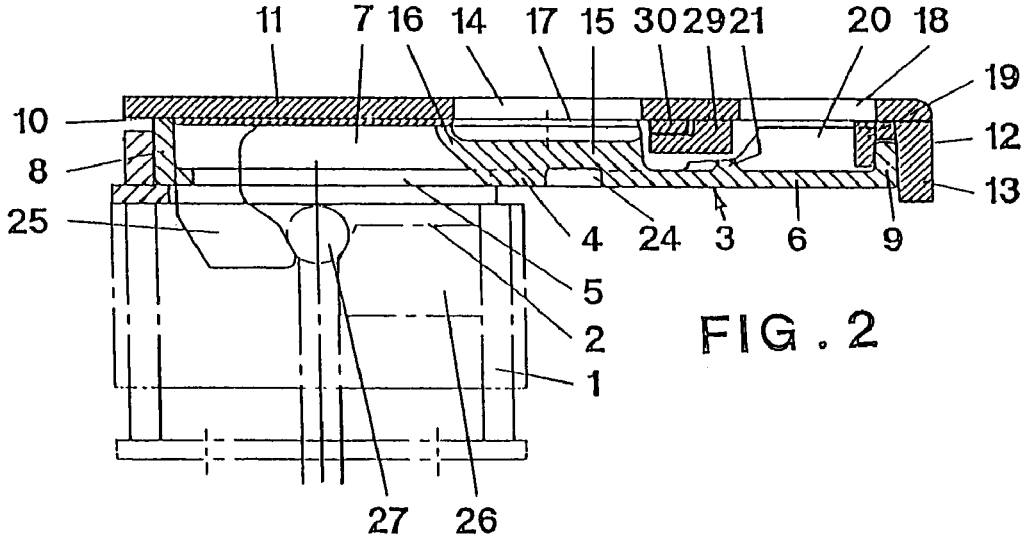
FIG. 2
FIG. 3
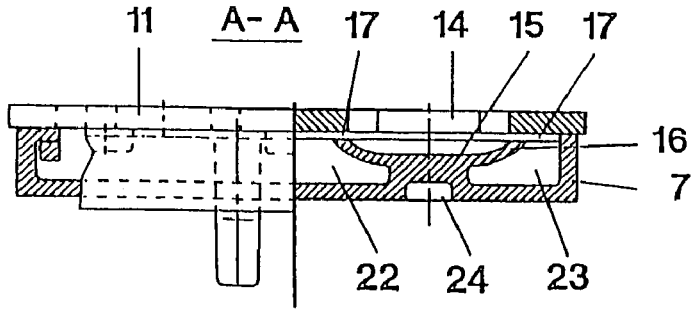

PLATE FOR A SLIDING COOLER GRATE

CROSS-REFERENCE TO RELATED APPLICATIONS

This is the national stage of International Application No. PCT/EP95/04370, filed Nov. 6, 1995 and which designated the United States.

BACKGROUND OF THE INVENTION

Push-type grates for coolers for cement clinker and suchlike pourable combustible material are known, these push-type grates being formed by grate-plate rows which extend transversely relative to the longitudinal direction of the grate and to the conveying direction of the material and which are alternately stationary and moved back and forth in the conveying direction. The individual grate plates of each row have a topside which forms the bearing surface for the bed of material to be cooled. They are carried by a grate-plate carrier, to which they are connected in the rear region of their underside via corresponding connection devices. They project forwards from the grate-plate carrier, in order to overlap the rear part of the grate plates of the next following grate-plate row. Under the load of the material resting on them, they are exposed to a bending moment and consequently, to support their front part, have stiffening devices which transmit the bending stress from the front plate part to the grate-plate carrier. The stiffening devices can be formed, for example, by longitudinal ribs (DE-C 24 32 599), by sidewalls of a box-shaped plate (EP-A 167,658; EP-A 337,383), by longitudinal battens of a frame-shaped design (EP-A 537,523) or by any other elements extending in the longitudinal direction. For the sake of simplicity, they are referred to here, in sum, as longitudinally extending ribs. These known grate plates are exposed on the topside to the high temperature of the material to be cooled and on the underside to the low temperature of the cooling air. They therefore expand to a greater extent on the topside than on the underside, this leading to arching or warping, as a result of which their front edge sinks a little. This may cause it to rub on the topside of the next following plate.

This also applies to box-shaped plates (EP-A 537,523, EP-A 337,383) which are composed of two plate parts arranged one above the other, namely of an upper frame-shaped part, the sidewalls of which form the said ribs, and a plate-shaped lower part. This disadvantage can be avoided by providing, by virtue of construction, appropriately large vertical play between successive plates, although this is undesirable because it causes more material to fall through in the region of overlap on the plates. There is a known grate plate (DE-A 24 54 202) which, on the topside, has a heat-resistant and wear-resistant ceramic layer held, with the possibility of horizontal expansion, by the lower part of the plate. The lower part of the plate has fastening elements both in its rear and its front region, from which it is to be concluded that the front region is held and locally fixed by any support parts not disclosed, so that the abovementioned disadvantage cannot arise. In contrast to this, the invention relates to that type, in which the individual grate plate is held solely in its rear region by the grate-plate carrier, projects' freely forwards and contains rib elements which are exposed on top to the effect of the temperature of the material or are fixedly connected to a part exposed to the temperature and which consequently experience the said warping.

SUMMARY OF THE INVENTION

The object on which the invention is based is to provide a grate plate which requires less vertical play between the plates and nevertheless does not lead to a rubbing of the plates on one another under the effect of heat.

Accordingly, the grate plate consists of two parts, namely the underside support part and the topside cover plate, the, support part having the ribs which are necessary for transmitting the bending force and for supporting the front plate part, whilst the cover plate is designed in such a way that it experiences lesser bending under heat stress. This occurs because it is free of the underside ribs. It is therefore made essentially flat, with a plate thickness which is substantially smaller than the vertical extent of the support part. Although it too is maintained at a lower temperature on the underside than on its topside by the cooling air, it is nevertheless stabilized by the support part, the ribs of which are not exposed to any appreciable temperature difference and which therefore does not warp. According to the invention, the flat design of the cover plate is to be present at least in that plate region which is located in front of the grate-plate carrier. Advantageously, however, the said flat design is achieved essentially also in the region of the grate-plate carrier. Since it must be expected that the cover plate, on account of its higher temperature, expands to a greater extent than the cooler support part, it is to have freedom of expansion in relation to the latter.

These requirements can be satisfied most easily if the cover plate and the support part are separate pieces, this also having the advantage that they can be made from different materials in conformity with the requirements (temperature resistance, wear resistance, toughness) which are different in each case, and that the cover plate can be exchanged as a wearing part independently of the support part. However, the invention does not intend to rule out a one-piece design. In either case, the two parts are fixedly connected to one another solely in a restricted region of their longitudinal extent, whereas, in the remaining part, although they can cooperate supportively, they are nevertheless independent of one another in terms of expansion in the longitudinal direction.

Grate designs, in which the grate-plate carrier serves for the supply of cooling air, have proved successful (EP-A 337,383; EP-A 537,523). For this purpose, the devices of the grate plate for connection to a grate-plate carrier can include a cooling-air supply orifice surrounded by a bearing edge which can be placed onto the topside of the grate-plate carrier and which is formed by the support part and is preferably connected to the ribs in a force-transmitting manner. At the same time, the cover plate and the support part jointly include ducts for guiding cooling air from the cooling-air supply orifice to cooling-air outlet orifices opening out on the topside. If, in this case, the grate plate contains on the topside open depressions for the reception and retention of material to be cooled, in which depressions at least some of the cooling-air outlet orifices open out, at least the bottom of the depressions is expediently formed by the support part, since it is not exposed to the high temperature of the material to be cooled, in contrast to the higher-placed topside of the cover plate. This also applies to any sidewalls of the depressions. The expansion gap between the cover plate and the bottom or the sidewalls of the depressions is then advantageously formed by the cooling-air outlet orifices. They are limited on the topside by the cover plate and on the underside by the support part and form a heat transport barrier, by virtue of which the support part is freed all the more from the influence of heat.

If the grate plate contains at least one front depression and a plurality of depressions arranged further to the rear, the cooling air must be guided from the cooling-air supply orifice provided on the grate-plate carrier, past the rear depressions to the front depression. So that, on the one hand, this is possible without considerable losses and, on the other hand, as large a surface region of the grate plate as possible can be provided for the depressions, the cross-sectional size of the cooling-air ducts, which are formed in each case between two rear depressions or between one rear depression and a lateral plate limitation, expediently decreases from the rear forwards.

So that the air can be guided from the cooling-air supply orifice provided on the grate-plate carrier to the cooling-air passage orifices arranged on the topside, these ducts must be closed on the underside of the grate plate. For this purpose, in known cooling grates (EP-A 537,523), there is arranged on the grate-plate carrier a bottom plate which extends forwards over the entire grate-plate length and which is more or less sealingly connected at its front lower edge. The disadvantage of this is that the grate plate cannot be exchanged downwards. Consequently, in the event of a repair, the grate has to be run empty and cooled until someone can walk on it. In another known grate plate (EP-A 167,658), the bottom is part of the grate plate, so that it can be exchanged downwards. Preferably, in the invention too, the bottom is part of the grate plate, namely is connected to the support part, in that the latter is designed to be closed at the bottom in front of the cooling-air supply orifice. This affords the possibility of mounting and deznounting the grate plate as a whole from below, and worn or damaged cover plates can easily be exchanged.

The devices for connecting the grate plate to a grate-plate carrier expediently comprise a clamping device which presses the bearing edge of the support part onto the topside of the grate-plate carrier and which engages on the cover plate. Although it would also be possible, instead, to clamp the support part directly onto the grate-plate carrier, in which case the connection of the cover plate to the support part would be independent of the connection of the support part to the grate-plate carrier, nevertheless the said feature in the simplest way makes a connection not only to the grate-plate carrier, but also between the cover plate and the support part.

According to the invention, the front region of the cover plate can rest freely on the support part, there being no positive connection between the front region of the cover plate and the support part. However, if there is a risk that the cover plate could warp or, in the case of specific thermal states, could lift off on the end face from the support part in an undesirable way, holding means which prevent such lifting-off, without impeding the expansion of the cover plate in the direction of its surface extent, can be provided.

Since the invention makes it possible to exchange the cover plate in the event of wear, it is also appropriate to provide an exchangeable wearing part for that region of the grate plate which is at the greatest risk of wear, namely its end face.

BRIEF DESCRIPTION OF THE DRAWINGS

The invention is explained in more detail below with reference to the drawing which illustrates an advantageous exemplary embodiment. In the drawing:

FIG. 1 shows a top view;

FIG. 2 is a longitudinal section along the line B—B of FIG. 1;

FIG. 3 is a partially cut away front view along the line A—A of FIG. 1;

DETAILED DESCRIPTION OF THE PREFERRED EMBODIMENT

Figure 4:
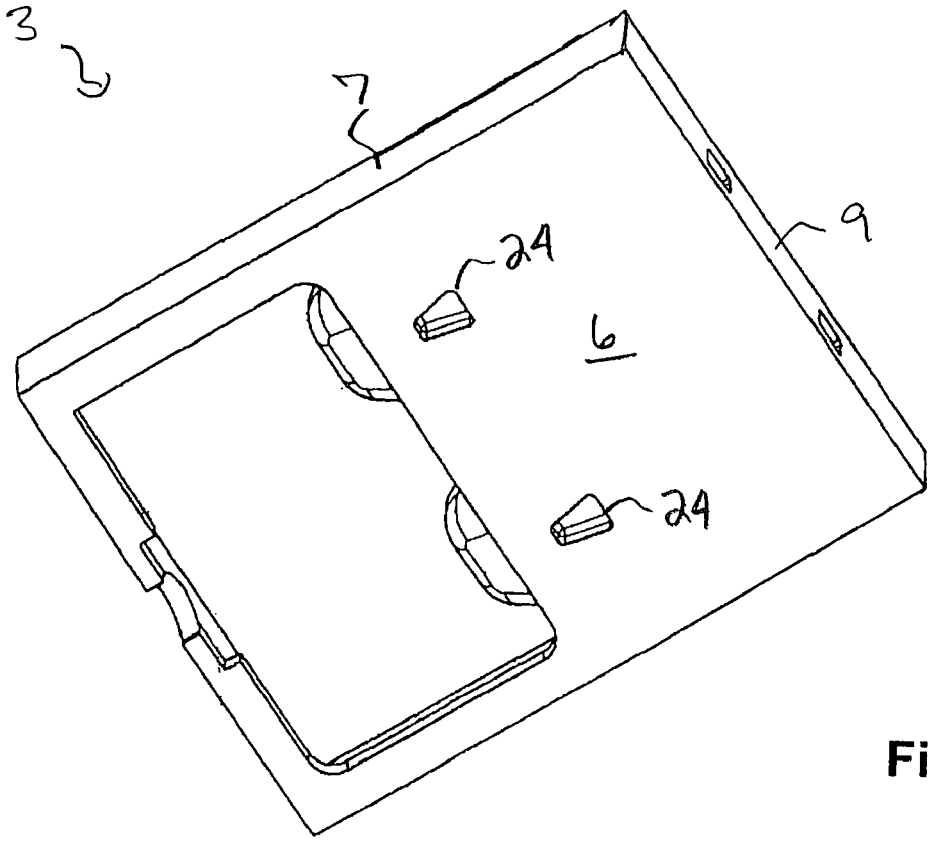
FIG. 4 is a first bottom perspective view of the support part of FIG. 2.
Figure 5:
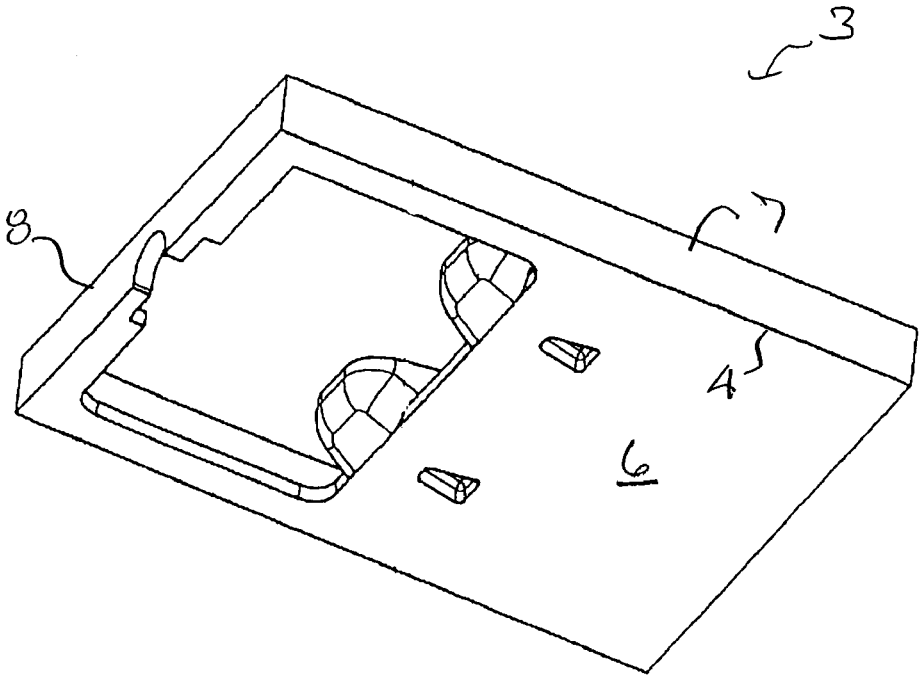
FIG. 5 is a second bottom perspective view of the support part of FIG. 2.
Figure 6:
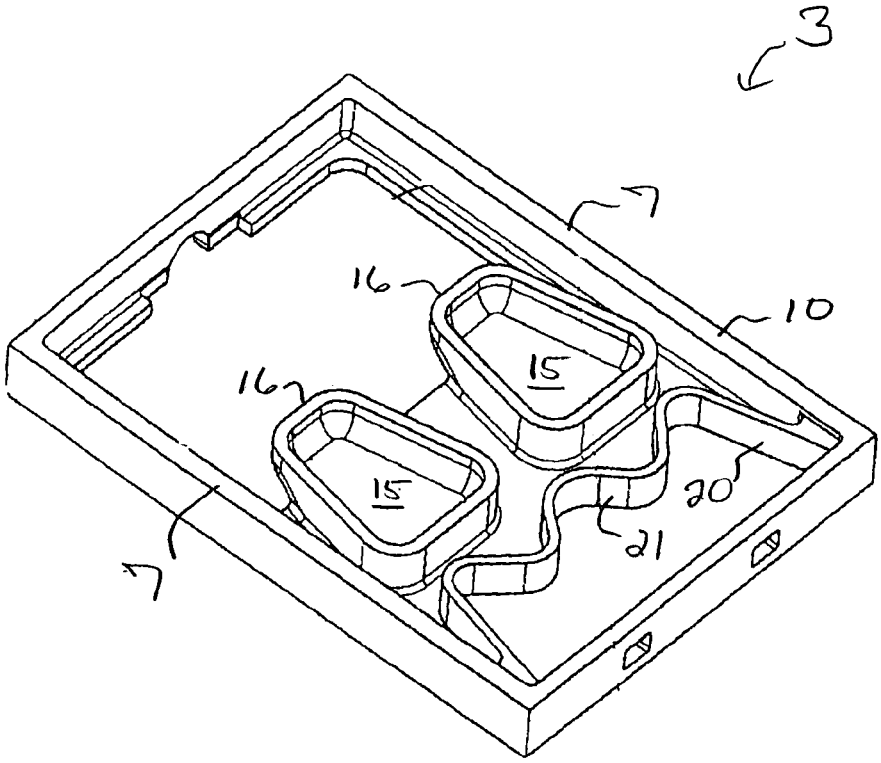
FIG. 6 is a top perspective view of the support part of FIG. 2.
Figure 7:
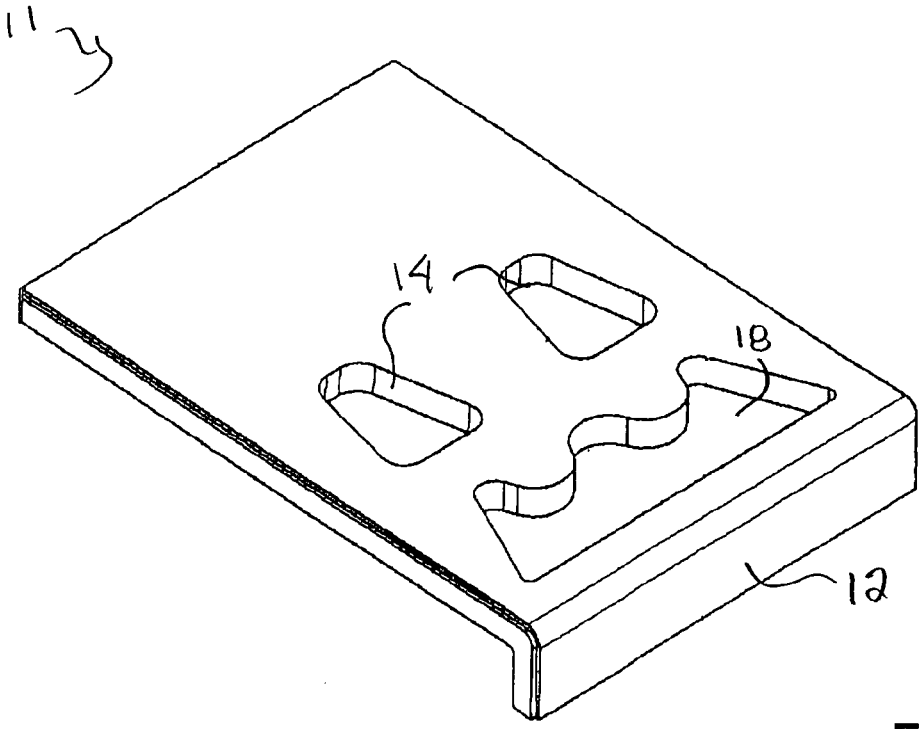
FIG. 7 is a top perspective view of the cover plate of FIG. 2.
Figure 8:
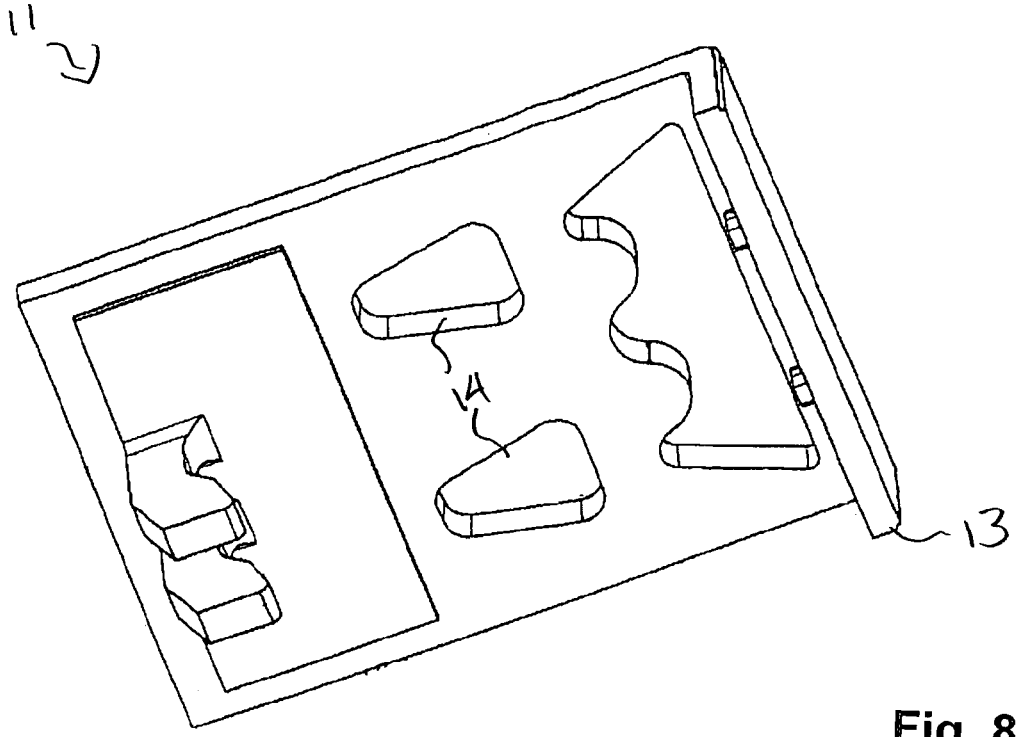
FIG. 8 is a first bottom perspective view of the support part of FIG. 2.
Figure 9:
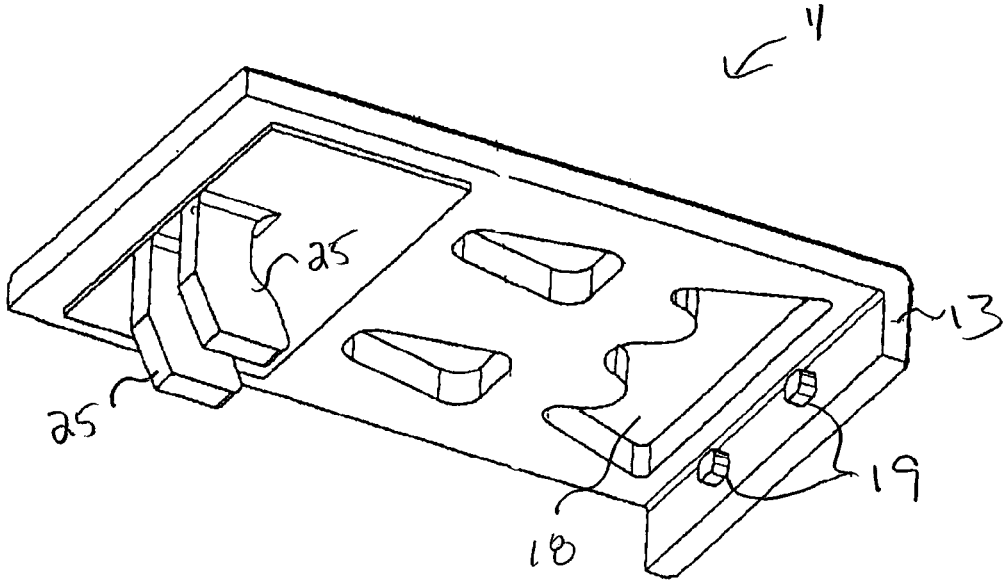
FIG. 9 is a second bottom perspective view of the cover plate of FIG. 2.

A multiplicity of plates, of which only one appears in the drawing, are arranged next to one another on the grate-plate carrier 1 which is formed continuously over the grate width by one or more hollow profiles. The topside of the grate-plate carrier 1 is cut out in the region of each grate plate to form a cooling-air supply orifice 2. It is surrounded by a top edge, on which the grate plate sits. For this purpose, there is provided on the underside of the support part 3 a correspondingly designed peripheral edge 4 which sits sealingly on the edge of the grate-plate carrier and which encloses the plate-side cooling-air supply orifice 5. The edge 4 has adjoining it forwards in one piece a bottom 6 which extends essentially parallel to the plane of the edge 4. From the edge 4 and the bottom 6 rises a peripheral frame of lateral edge strips 7, of a rear edge strip 8 and of a front edge strip 9 which form an upper bearing surface 10 which is essentially parallel to the topside of the grate-plate carrier 1 and on which the plane underside of the cover plate 11 rests. The latter has an essentially constant thickness which is small in relation to the total vertical extent of the grate plate and which is preferably in the range of 10 to 20 mm. Its topside, insofar as it is not covered by a grate plate adjacent at the rear, forms the bearing surface for the bed of material to be cooled. In the design according to FIG. 2, the said cover plate extends at the front as far as the end face 12 of the plate and participates in the formation of the said end face. Suspended under the front edge of the said cover plate, in front of the support part 3 of the plate, is a wearing strip 13 which carries at the rear one or more hooks, by means of which it is retained on the front edge strip 9 of the support part 3. In an alternative design not shown, this wearing strip is drawn up level with the topside of the cover plate 11 and thus forms the end face 12 of the plate as a whole.

Provided next to one another in the middle region of the grate plate are two topside depressions 14 which are intended for receiving and retaining material to be cooled. They are formed by correspondingly shaped cutouts in the cover plate 11 and recesses in the support part which consist of a recess bottom 15 and recess walls 16. The shape of the recess walls 16 corresponds, in the top view, to the shape of the plate cutouts 14. In relation to the edge of the cutouts, they can be aligned vertically with this, but, in the example shown (see FIGS. 2 and 3), they are set back a little.

The front and rear parts of the recess walls 16 reach as far as the bearing surface 10 and participate in supporting the cover plate 11. In contrast, gaps 17, which serve as cooling-air outlet orifices, are formed between the lateral recess walls 16 and the cover plate 11.

A further depression 18, which extends over virtually the entire width of the grate plate, is located in the front part of the grate plate. It is limited at the bottom by the bottom 6 of the support part, at the front by the hook 19 of the wearing strip 13 and laterally and at the rear by recess walls 20, 21. The recess walls 20, 21 form, with the underside of the cover plate 11, a gap as an air outlet orifice. The rear recess wall 21 extends in a wave-like manner in the top view, in order to give the associated air outlet orifice the greatest possible length. The lateral recess walls 20 extend obliquely inwards to the rear in relation to the lateral edge strips 7 of the support part, in order to afford the best possible inflow conditions. To provide optimum flow conditions, at the same time with the largest possible proportion of depressions on the total surface of the plate, the lateral recess walls 16 of the depressions 14 likewise extend obliquely, the distance between the adjacent recesses 14 or between the recesses 14 and the adjacent lateral edge strips 7 of the support part decreasing forwards in conformity with the forwardly decreasing cooling-air quantity which is conveyed through the ducts next to the depressions 14.

To enlarge the cross-sections of these ducts, they extend partially underneath the recess bottoms 15. As can be seen in the right-hand half of FIG. 3, the recesses of the depressions 14 in the support part are made mushroom-like, thereby on the one hand increasing the cross-sectional size of the ducts 22, 23 and on the other hand reinforcing the cooling of the recesses.

Provided underneath the recess bottoms 15, in the underside of the bottom 6 of the support part, are depressions 24, in which tools can engage during the mounting and demounting of the plates.

Provided in the rear region of the cover plate 11, on the underside of the latter, are key heads 25 which, in cooperation with key heads 26 and clamping bolts 27 provided on the grate-plate carrier 1, serve for clamping the grate plate onto the grate-plate carrier and locally fixing it. Since the support part 3 is therefore clamped indirectly via the cover plate 11, a connection of the cover plate 11 with the support part 3 is also made in this way. The wearing strip 13 is likewise fixed thereby, since it is held between the cover plate 11 and the support part 3.

By means of the clamping device 25 to 27, the cover plate is locally fixed in its rear region. Forwards, it has the possibility of free expansion, as immediately becomes clear from a consideration of FIG. 2.

As a rule, there is no need to provide, in the front region, any devices which hold the cover plate 11 on the support part. However, it is possible to provide there devices which prevent the cover plate from being lifted off, for example in the form of hooks 29 which are arranged on the cover plate and which engage under lateral projections 30 of the support part.

In the example shown, the lateral edge strips 7 and partially the recesses and recess walls form those parts of the support part 3 which provide stiffening in the longitudinal direction and which are referred to as ribs in the description introduction.

The cover plate is preferably plane; however, it can also be designed, in its front part, to rise slightly in relation to its rear part arranged approximately horizontally.

What is claimed is:

1. Grate plate for the push-type grate of a cooler, especially for cement clinker, which has a topside bearing surface exposed to the hot material to be cooled and, in the rear region of the said grate plate, devices for connection to a grate-plate carrier and which is intended to engage with its front projecting part over an adjacent grate plate, there being provided for the purpose of supporting the front plate part longitudinally extending edge strips which are connected in a force-transmitting manner to the devices for connection to the grate-plate carrier, characterized in that the topside bearing surface exposed to the hot material to be cooled is formed by a cover plate which is free of the edge strips, at least in front of the grate-plate carrier, and which has freedom of expansion in the horizontal direction in relation to the support part comprising the edge strips.

2. Grate plate according to claim 1, characterized in that the cover plate and the support part are separate pieces.

3. Grate plate according to claim 1, characterized in that the devices for connecting the grate plate to a grate-plate carrier comprise a bearing edge which encloses a cooling-air supply orifice, can be placed onto the topside of the grate-plate carrier and is formed by the support part, and in that the cover plate and the support part jointly enclose cooling-air ducts for guiding cooling air from the cooling-air supply orifice to cooling-air outlet orifices opening out on the topside.

4. Grate plate according to claim 1, characterized in that it contains, on the topside, open recesses for the reception and retention of material to be cooled, in which recesses at least some of the cooling-air outlet orifices open out, at least the bottom of the depressions being formed by the support part.

5. Grate plate according to claim 4, characterized in that the walls of the depressions are also formed at least partially by the support part.

6. Grate plate according to claim 4, characterized in that the cooling-air outlet orifices are limited on the topside by the cover plate and on the underside by the support part.

7. Grate plate according to claim 1, characterized in that it contains at least one foremost depression and a plurality of depressions arranged further to the rear, the walls which form the rear depressions enclosing between one another and/or between themselves and the edge strips cooling-air ducts which lead to the front depression.

8. Grate plate according to claim 7, characterized in that the cooling-air outlet orifices of the rear depressions are arranged in their side faces participating in the formation of the cooling-air ducts, and the cross-sectional size of the cooling-air ducts between adjacent depressions or between the depressions and a edge strips decreases from the rear forwards.

9. Grate plate according to claim 1, characterized in that the devices for connection to the grate-plate carrier include a cooling-air supply orifice and the support part is designed to be closed at the bottom in front of the cooling-air supply orifice.

10. Grate plate according to claim 1, characterized in that the devices for connecting the grate plate to a grate-plate carrier comprise a clamping device which presses the bearing edge of the support part onto the topside of the grate-plate carrier and which engages on the cover plate.

11. Grate plate according to claim 1, characterized in that the front region of the cover plate rests freely on the support part.

12. Grate plate according to claim 1, characterized in that the front part of the cover plate and the support part are provided with devices for preventing the cover plate from being lifted off from the support part.

13. Grate plate according to claim 1, characterized in that it includes an exchangeable wearing strip is placed in front of the support part on the end face.

* * * * *